US006175072B1

(12) United States Patent
Aoki

(10) Patent No.: US 6,175,072 B1
(45) Date of Patent: Jan. 16, 2001

(54) AUTOMATIC MUSIC COMPOSING APPARATUS AND METHOD

(75) Inventor: Eiichiro Aoki, Hamamatsu (JP)

(73) Assignee: Yamaha Corporation, Hamamatsu (JP)

( * ) Notice: Under 35 U.S.C. 154(b), the term of this patent shall be extended for 0 days.

(21) Appl. No.: 09/368,435

(22) Filed: Aug. 4, 1999

(30) Foreign Application Priority Data

Aug. 5, 1998 (JP) ..... 10-233572

(51) Int. Cl.[7] ..... G10H 1/40
(52) U.S. Cl. ..... 84/636; 84/DIG. 12
(58) Field of Search ..... 84/609–614, 634–638, 84/DIG. 12

(56) References Cited

U.S. PATENT DOCUMENTS

| | | | | |
|---|---|---|---|---|
| 4,704,933 | * | 11/1987 | Kurakake | 84/612 |
| 4,969,384 | * | 11/1990 | Kawasaki et al. | 84/612 |
| 5,278,348 | * | 1/1994 | Eitaki et al. | 84/636 |
| 5,281,754 | * | 1/1994 | Farrett et al. | 84/612 X |
| 5,672,837 | * | 9/1997 | Setoguchi et al. | 84/612 X |
| 5,736,663 | | 4/1998 | Aoki et al. . | |
| 5,973,255 | * | 10/1999 | Tanji | 84/636 |

FOREIGN PATENT DOCUMENTS 9-81141 3/1997 (JP) .

* cited by examiner

*Primary Examiner*—Stanley J. Witkowski
(74) *Attorney, Agent, or Firm*—Morrison & Foerster

(57) ABSTRACT

The apparatus stores a data base including a plurality of sets of composition parameter data for a plurality of numbers of measures, each set of composition parameter data defining characteristics of a music piece to be composed, the characteristics including music structures, and at least one set of composition parameter data being provided for each number of measures among the plurality of numbers of measures. The user inputs composition conditions such as a length of time, a tempo and a meter for a music piece to be composed. The apparatus calculates the number of measures of the music piece based on the inputted time length, tempo and meter. A plurality of candidate data sets of composition parameters are searched for in the data base and displayed for the user's selection. The user selects a desired one, and the apparatus generates a melody satisfying the inputted composition conditions. When there may be a disparity between the time length of the generated melody and the time length in the inputted composition conditions, the tempo of the generated melody may be adjusted such that the both lengths become equal.

32 Claims, 4 Drawing Sheets

*Fig.4*

Composition Parameters Data Base

| Length (sec) | Tempo M.M. ♩ = | Meter | Number of Measures | Composition Parameters |
|---|---|---|---|---|
| 10 | 96 | 4/4 | 4 | . . . . |
| 10 | 72 | 3/4 | 4 | . . . . |
| 10 | 192 | 4/4 | 8 | . . . . |
| 10 | 144 | 3/4 | 8 | . . . . |
| 20 | 96 | 4/4 | 8 | . . . . |
| 20 | 72 | 3/4 | 8 | . . . . |
| 20 | 144 | 4/4 | 12 | . . . . |
| 20 | 108 | 3/4 | 12 | . . . . |
| 20 | 192 | 4/4 | 16 | . . . . |
| 20 | 144 | 3/4 | 16 | . . . . |
| 40 | 72 | 4/4 | 12 | . . . . |
| 40 | 96 | 4/4 | 16 | . . . . |
| 40 | 72 | 3/4 | 16 | . . . . |
| 40 | 144 | 4/4 | 24 | . . . . |
| 40 | 108 | 3/4 | 24 | . . . . |
| 40 | 192 | 4/4 | 32 | . . . . |
| 40 | 144 | 3/4 | 32 | . . . . |
| 60 | 64 | 4/4 | 16 | . . . . |
| 60 | 96 | 4/4 | 24 | . . . . |
| 60 | 72 | 3/4 | 24 | . . . . |
| 60 | 128 | 4/4 | 32 | . . . . |
| 60 | 96 | 3/4 | 32 | . . . . |
| 60 | 192 | 4/4 | 48 | . . . . |
| 60 | 144 | 3/4 | 48 | . . . . |
| 60 | 180 | 3/4 | 60 | . . . . |
| 80 | 72 | 4/4 | 24 | . . . . |
| 80 | 96 | 4/4 | 32 | . . . . |
| 80 | 72 | 3/4 | 32 | . . . . |
| 80 | 144 | 4/4 | 48 | . . . . |
| 80 | 108 | 3/4 | 48 | . . . . |
| 80 | 180 | 4/4 | 60 | . . . . |
| 80 | 135 | 3/4 | 60 | . . . . |
| 100 | 76.8 | 4/4 | 32 | . . . . |
| 100 | 115.2 | 4/4 | 48 | . . . . |
| 100 | 86.4 | 3/4 | 48 | . . . . |
| 100 | 144 | 4/4 | 60 | . . . . |
| 100 | 108 | 3/4 | 60 | . . . . |
| 120 | 64 | 4/4 | 32 | . . . . |
| 120 | 96 | 4/4 | 48 | . . . . |
| 120 | 72 | 3/4 | 48 | . . . . |
| 120 | 120 | 4/4 | 60 | . . . . |
| 120 | 90 | 3/4 | 60 | . . . . |

AUTOMATIC MUSIC COMPOSING APPARATUS AND METHOD

BACKGROUND OF THE INVENTION

1. Field of the Invention

The present invention relates to an automatic music composing apparatus and method, and a machine readable medium containing program instructions for realizing such an apparatus and a method using a computer system, and more particularly to an apparatus and a method capable of composing a music piece having a desired length of time as designated by the user, in which the number of measures for a music piece to be composed are calculated from the designated length of time, the tempo and the meter, and then the data base including composition parameters for defining characteristics of music compositions are searched for retrieving the composition parameters which meet the calculated number of measures to automatically generate a melody based on the retrieved composition parameters.

2. Description of the Prior Art

Apparatuses for composing a piece of music or a melody (tune) based on the composition parameters defining characteristics of a music composition read out from a data bass are known in the art (see unexamined Japanese patent publication No. H9-50278, whose counterpart is issued U.S. Pat. No. 5,736,663). Such an apparatus handles data sets of composition parameters, each composition parameter data set including a data set representing a music structure in terms of a sentence pattern such as <A-B-C-C'> and a data set representing musical features such as a melody feature and a rhythm feature.

Among the prior art, there is also a type of automatic music composing apparatus which is capable of generating a melody having a length of time as designated by the user, for example, as shown in unexamined Japanese patent publication No. H9-81141. But, such an apparatus stores in the data base a plurality of note value data strings for several different lengths of time, selects a note value data string which matches the designated length of time, and imparts pitches to the respective note values in the selected data string to construct a melody. It does not disclose an idea of utilizing a technique of storing composition parameter data sets depending on the number of measures, i.e. for each of a plurality of numbers of measures. Nor does it have a plurality of composition parameter data sets for each length of time among various lengths of time so that the user can select a desired music structure and/or other characteristics for an intended length.

With the apparatus of the above-mentioned conventional type, various melodies with various rhythms cannot be generated for a designated length of time, and further the length of time of the generated melody cannot be adjusted precisely to meet the designated length of time, still keeping the naturalness in musical feeling at a proper tempo.

SUMMARY OF THE INVENTION

It is, therefore, a primary object of the present invention to provide a novel type of music composing apparatus and method, and a machine readable medium containing a program therefor capable of composing music pieces of variety of musical structures for any designated length of time.

According to the present invention, the object is accomplished by providing an automatic music composing apparatus comprising: a storage device which stores a plurality of sets of composition parameter data for a plurality of numbers of measures, each set of composition parameter data defining characteristics of a music piece to be composed, and at least one set of composition parameter data being provided for each number of measures among the plurality of numbers of measures; an input device for inputting a length of time for a music piece to be composed; a tempo providing device which provides a tempo for a music piece to be composed; a calculating device which calculates the number of measures for a music piece to be composed based on the inputted length of time and the tempo; a read-out device which reads out from the storage device a set of composition parameter data which is for the calculated number of measures; and a music piece generating device which generates, based on the read out set of composition parameter data, a music piece having a length of time in the tempo and having characteristics as defined by the read out set of composition parameter data.

The automatic music composing apparatus of the above-mentioned structure may further comprise: a detecting device which detects a disparity between the inputted length of time and the length of time of the generated music piece; and a tempo adjusting device which adjusts the tempo of the generated music piece so that the length of time of the generated music piece be substantially equal to the inputted length of time.

With such an apparatus, the user inputs a desired length of time for a music piece to be composed, and then the number of measures for the music piece to be composed is calculated based on the inputted length of time corresponding to the given tempo and meter. Then, composition parameter data sets are read out from the storage device corresponding to the calculated number of measures, and a music piece will be automatically generated based on the read out composition parameter data. The generated music piece, therefore, has a length of time which is equal to or closely equal to the inputted length of time. Further, in the case of comprising the above disparity detecting device and tempo adjusting device, the length of time of the generated music piece will be very close to the inputted length of time.

According to the present invention, the object is further accomplished by providing an automatic music composing apparatus comprising: a storage device which stores a plurality of sets of composition parameter data for a plurality of numbers of measures, each set of composition parameter data defining characteristics of a music piece to be composed, the characteristics including music structures, and at least one set of composition parameter data being provided for each number of measures among the plurality of numbers of measures; an input device for inputting a length of time for a music piece to be composed; a tempo providing device which provides a tempo for a music piece to be composed; a calculating device which calculates the number of measures for a music piece to be composed based on the inputted length of time and the tempo; a display device which displays a plurality of music structures defined by the plurality of sets of composition parameter data corresponding to the calculated number of measures; a selecting device which selects a music structure from among the displayed plurality of music structures; a read-out device which reads out from the storage device a set of composition parameter data including the selected music structure; and a music piece generating device which generates, based on the read out set of composition parameter data, a music piece having a length of time in the tempo and having characteristics as defined by the read out set of composition parameter data.

With the apparatus of the preceding paragraph, the user inputs a desired length of time for a music piece to be composed, and then the number of measures for the music piece to be composed is calculated based on the inputted length of time corresponding to the given tempo and meter. Then, the display device displays a plurality of music structures defined by the plurality of sets of composition parameter data corresponding to the calculated number of measures. Upon selection, by the user, of a desired one from among the displayed plurality of music structures, the composition parameter data set including the selected music structure is read out from the storage device, and a music piece will be automatically generated based on the read out composition parameter data. The generated music piece, therefore, has a length of time which is equal to or closely equal to the inputted length of time and has the selected music structure.

According to the present invention, the object is still further accomplished by providing an automatic music composing apparatus comprising: a storage device which stores a plurality of sets of composition parameter data for a plurality of lengths of time, each set of composition parameter data defining characteristics of a music piece to be composed, and a plurality of sets of composition parameter data being provided for each length of time among the plurality of lengths of time; an input device for inputting a length of time for a music piece to be composed; a tempo providing device which provides a tempo for a music piece to be composed; a read-out device which reads out from the storage device a set of composition parameter data which is for the inputted length of time; and a music piece generating device which generates, based on the read out set of composition parameter data, a music piece having a length of time in the tempo and having characteristics as defined by the read out set of composition parameter data.

With the apparatus of the preceding paragraph, the user inputs a desired length of time for a music piece to be composed, and then the read-out device reads out from the storage device a set of composition parameter data which meets the inputted length of time, and a music piece will be automatically generated based on the read out composition parameter data. The generated music piece, therefore, has a length of time which is equal to or closely equal to the inputted length of time.

As will be apparent from the description herein later, some of the structural element devices of the present invention are configured by a computer system performing the assigned functions according to the associated programs. They may of course be hardware structured discrete devices.

As will be understood from the above description about the apparatus for composing a music piece, a sequence of the steps each performing the operational function of each of the structural elements of the above music composing apparatus will constitute a method for composing a music piece according to the spirit of the present invention.

Further as will be understood from the above description about the apparatus and the method for composing a music piece, a machine readable medium containing a program instructions executable by a computer system for executing a sequence of the processes each performing the operational function of each of the structural elements of the above music composing apparatus or performing each of the steps constituting the above music composing method will reside within the spirit of the present invention.

BRIEF DESCRIPTION OF THE DRAWINGS

For a better understanding of the present invention, and to show how the same may be practiced and will work, reference will now be made, by way of example, to the accompanying drawings, in which:

FIG. 4 is a list showing how the composition parameter sets are provided with respect to the length of time, the tempo, the meter and the number of measures.

DESCRIPTION OF THE PREFERRED EMBODIMENTS

Figure 1:
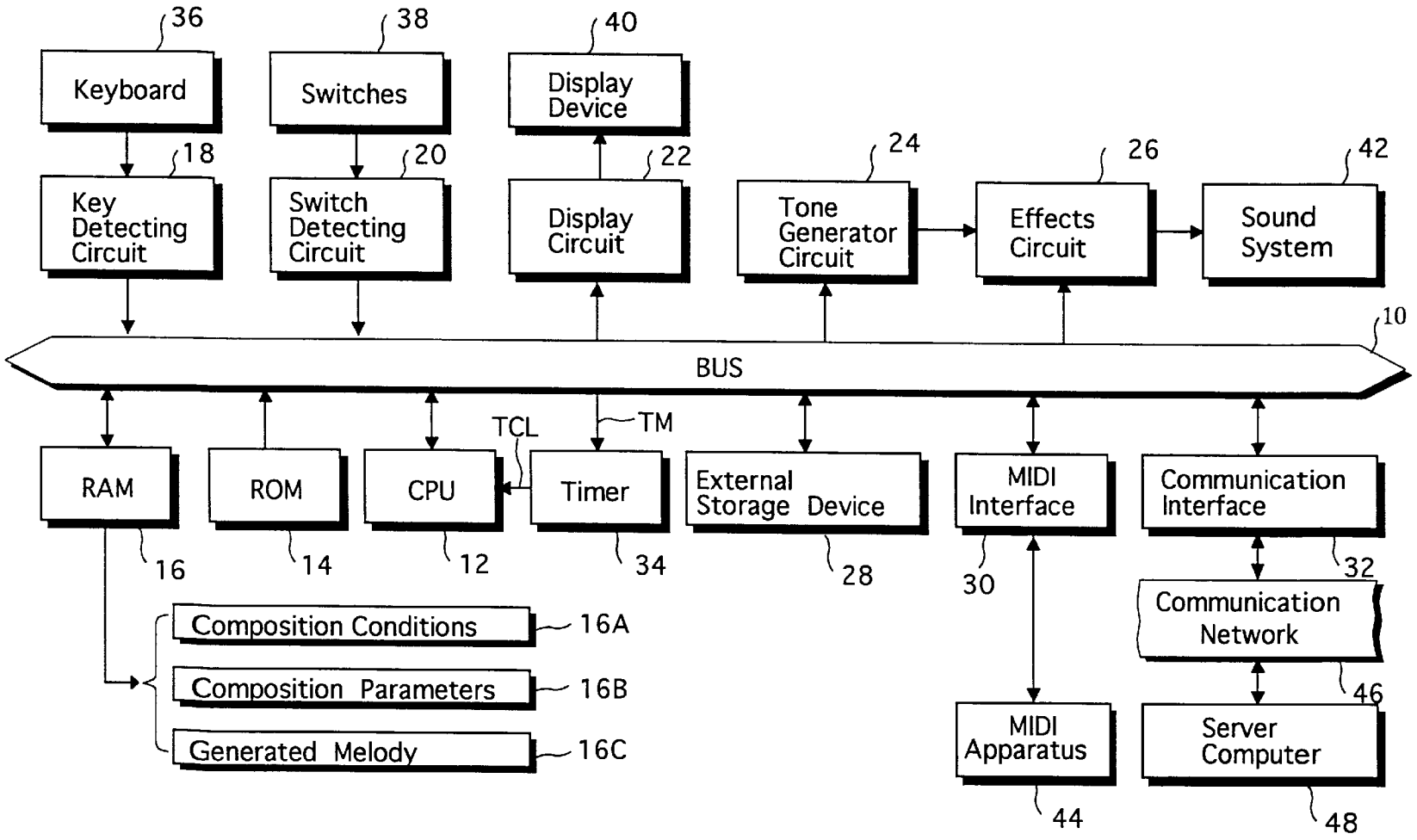
FIG. 1 is a block diagram showing an example of an electronic musical instrument embodying an automatic music composing apparatus according to the present invention.

FIG. 1 is a block diagram showing a structure of an example of an electronic musical instrument embodying an automatic music composing apparatus according to the present invention. This electronic musical instrument is configured to generate musical tones, to compose a music piece or tune and to conduct associated operations under the control of a personal computer or small scale computer.

Connected to a bus 10 are a CPU (central processing unit) 12, a ROM (read only memory) 14, a RAM (random access memory) 16, a key detecting circuit 18, a switch detecting circuit 20, a display circuit 22, a tone generator circuit 24, an effects circuit 26, an external storage device 28, a MIDI interface 30, a communication interface 32, and a timer 34.

The CPU 12 executes various kinds of processing including generating tones and composing a music piece or tune according to the programs stored in the ROM 14. The details of the music composing processing will be described herein later with reference to FIG. 3. The ROM 14 stores, in addition to the programs, a data base comprising a plurality of sets of data defining characteristics of music compositions (composition parameters) with respect to various numbers of measures, in which there are different sets of composition parameters (in contents) for each number of measures. For example, there are provided plural composition parameter data sets (different in contents) for a musical sentence of four measures, other plural composition parameter data sets for a musical sentence of eight measures, further plural composition parameter data sets for a musical sentence of twelve measures, and further plural composition parameter data sets for a musical sentence of sixteen measures. Each of the data sets for defining characteristics of a music composition includes a music structure data block representing a structure of a music piece in terms of a musical sentence pattern such as A-A'-B-C (symbols in terms of similarity among sentences), the number of measures in a musical sentence (e.g. each sentence consists of four measures) and so forth, and a musical feature data block representing features of a music piece in terms of a melody feature (note pitch variation pattern), a rhythm feature (rhythm pattern) and so forth. A plurality of data sets for defining characteristics of a music composition are provided for each number of measures and include various kinds of data sets which are different from each other in structures (sentence pattern and/or number of measures in each sentence). This is for the user to select a data set defining characteristics for a music piece to be composed of a desired music structure according to his/her preference. The RAM 16 includes various storage subdivisions (areas) to be accessed by the CPU 12 for various kinds of processing, wherein the primary ones may be a composition condition storing subdivision 16A, a composition parameter storing subdivision 16B and a generated music piece storing subdivision 16C.

The key detecting circuit 18 is to detect the manipulated states of the keys in a keyboard 36. The switch detecting circuit 20 is to detect the manipulation states of each of the switches 38. The switches 38 include, for example, an alphanumeric keyboard for inputting alphanumeric characters and a mouse for inputting commands on the display panel. The display circuit 22 controls the operation of the display device 40 for displaying various images on the screen.

The tone generator 24 includes a plurality of tone generation channels for generating plural tones simultaneously for a polyphonic performance. The types of the tone generating fashion may be arbitrarily employed from among the waveform memory type, the FM synthesis type, the physical model type, the harmonics synthesis type, the formant synthesis type, the analog synthesizer type including VCO's, VCF's, VCA's, etc. and any other types. The tone generator 24 may not be limited to a hardware device exclusively provided for tone generation, but may be a combination of a DSP (digital signal processor) and a microprogram, or a combination of a CPU and a software program. The plurality of tone generating channels may be constructed by individual separate circuits in the number corresponding to the number of channels, or may be constructed by a single circuit operated in a time division multiplexed fashion.

The effects circuit 26 is to impart to the tone signals generated by the tone generator circuit 24 various effects such as a chorus effect and a reverberation effect. The tone signals outputted from the effects circuit 26 are supplied to the sound system 42 to be converted into audible sounds.

The external storage device 28 is a storage device detachably including a storage medium or media of one or more types such as a hard disk (HD), a floppy disk (FD), a compact disk (CD), a digital versatile disk (DVD) and a magneto-optical disk (MO). When the external storage device 28 is equipped with a desired storage medium, the data in the storage medium can be transferred to the RAM 16. And where the equipped storage medium is of a writable type as an HD and an FD, the data in the RAM 16 can be transferred to such a storage medium.

As the data base of the data sets for defining characteristics of music compositions (composition parameters), the storage medium (such as the above HD, FD, CD, DVD and MO) equipped in the external storage device 28 may be used, in place of the ROM 14. As the means for storing the programs, such a storage medium equipped in the external storage device 28 may also be used, in place of the ROM 14. In such a latter situation, the program stored in the storage medium is transferred from the external storage device 28 to the RAM 16, and the CPU 12 is operated according to the thus transferred program as stored in the RAM 16. Such a configuration is advantageous in that an addition or an up-grading of the program will be easily made.

The MIDI interface 30 is provided to transmit performance information and so forth to and receive the same from another MIDI apparatus 44 such as an automatic performance apparatus. The communication interface 32 is provided to communicate with a server computer 48 via a communication network 46 such as a LAN (local area network), the Internet and a telephone line. The programs and various data which are necessary for practicing the present invention may be down-loaded into the RAM 16 or into the external storage device 28 from the server computer 48 via the communication network 46 and the communication interface 32 with a down loading request.

The timer 34 is to generate a tempo clock signal TCL at a period corresponding to given tempo data TM. The tempo clock signal TCL is supplied to the CPU 12 as an interrupt request signal. Upon receipt of each pulse of the tempo clock signal TCL, the CPU 12 initiates an interrupt routine. Making use of the interrupt processing, an automatic music performance can be realized based on the generated music (melody) data stored in the storage subdivision 16C.

In the above described electronic musical instrument, every time a key is depressed in the keyboard 36, the CPU 12 supplies to the tone generator 24 a pitch information signal and a tone generation instructing signal corresponding to the depressed key. The tone generator 24 generates a musical tone signal having a pitch corresponding to the depressed key in response to the pitch information signal and the tone generation instruction signal. Thus, the tones for a manual musical performance are generated.

Figure 2:
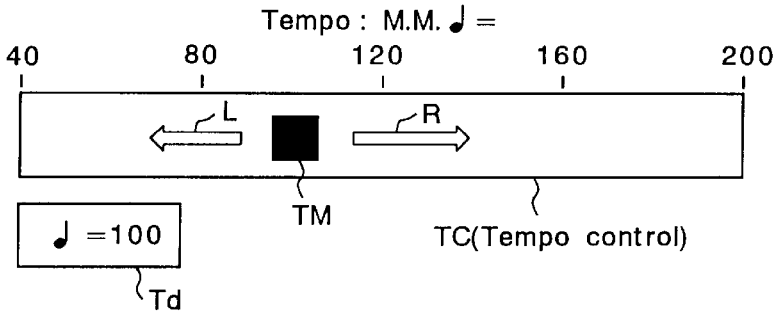
FIG. 2 is a chart showing a tempo control device of a panel display type.
Figure 3:
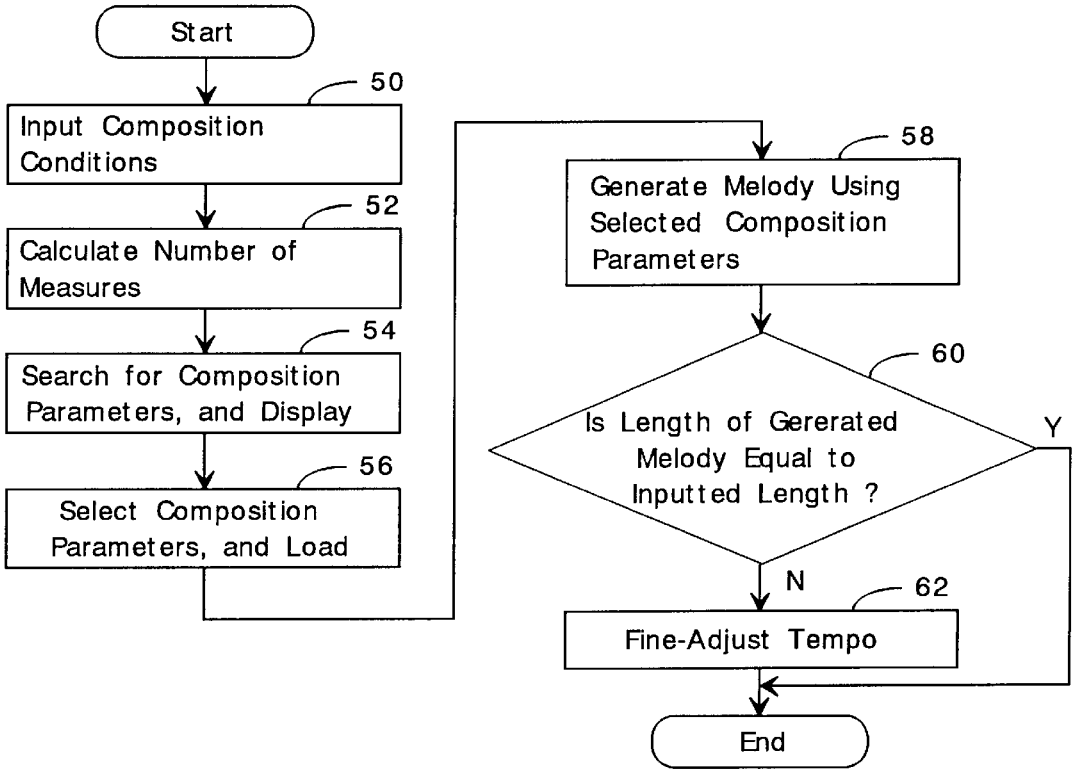
FIG. 3 is a flow chart showing the main routine of the processing for composing a music piece in a first embodiment of the present invention.

FIG. 2 shows an example of a tempo control panel used in operating the present invention. The tempo control TC is a picture of a panel exhibited on the display device 40 when the music composing routine of FIG. 3 is executed, and is used in setting the tempo for the musical piece to be composed. According to the setting by the tempo control TC, the computer-configured system of FIG. 1 provides a tempo (in the form of data) to be used in the operation of the system. The tempo control panel TC is a box in the shape of a horizontally elongated rectangle with tempo scale marks such as "40", "120" and "200" indicating the numbers of quarter notes per minute just above the box along the length thereof and with a square pointer mark Tm within the box. The pointer mark Tm may be moved leftward or rightward as shown by hollow arrows L and R by the actuation of the switches or the dragging manipulation of the mouse included in the switch group 38. The tempo is set corresponding to the staying position of the pointer mark Tm, and the tempo value as being set is shown in the tempo display window Td, for example, as "100" quarter notes per minute. In rendering the automatic performance of a music piece, the tempo value of the tempo data TM can be set by the tempo control TC. The tempo thus set here is a temporary one, and therefore may be set roughly.

FIG. 3 shows a processing flow of the main routine for composing a music piece in a first embodiment of the present invention. A step 50 is for inputting composition conditions for a piece of music to be composed such as the length of time, the tempo (temporary tempo), the meter, the key, the style and the musical instrument to play. The user inputs the composition conditions by the manipulation of the switches or the mouse included in the switch group 38. The length of time is inputted, for example, as "30" seconds using the ten-key buttons, the tempo is inputted, for example, as "120" using the tempo control TC of FIG. 2, and the meter is inputted, for example, as "4/4" meter. The manner of inputting the tempo may be such that several tempos are exhibited on the screen of the display device 40 such as "Slow (M.M. Quarter Note=60)", "Moderate (M.M. Quarter Note=120)" and "Rapid (M.M. Quarter Note=140)" and the user selects a desired one. The tempo may be inherently provided in the system as an adequate default value (e.g. "104") so that the default value should be used in case no tempo is inputted (designated) by the user and that the inputted value should supersede the default value in case a tempo value is inputted by the user. Similarly, the manner of inputting the meter may be such that several typical meters are displayed on the panel of the display device 40 such as "4/4 Meter" and "3/4 Meter" and the user selects a desired one. The meter may also be inherently provided in the system as an adequate default value (e.g. "quadruple" i.e. 4/4) so that the default value may be used in case no meter is inputted by the user and that the inputted value may supersede the default value in case a meter value is inputted by the user. The composition conditions such as the time length, the tempo and the meter, as inputted by the user (or provided as default values in the system) are written in the storage subdivision 16A of the RAM 16.

A step 52 calculates the number of measures of a music piece or tune to be composed based on the data of the length of time, the tempo and the meter stored in the storage subdivision 16A. An actual example of such calculation of the number of measures will be described hereinlater. Then the process moves forward to a step 54. The step 54 searches the data base described hereinbefore for a plurality of data sets of composition parameters corresponding to the number of measures as calculated at the step 52, and displays the structures of a music piece out of the above plurality of data sets of composition parameters on the screen of the display device 40. An actual example of such structures displayed on the screen will be described hereinlater. Then the process moves to a step 56.

The step 56 is to select any of the plurality of structures for a music piece as displayed on the screen of the display device 40. In response to the selection of a desired music structure by the user manipulating the switches or the mouse in the switch group 38, the step 56 reads out the data sets for defining characteristics of a music composition (composition parameters) that include the selected structure from the above data base and loads (write) into the storage subdivision 16B of the RAM 16, before going forward to a step 58.

The step 58 creates automatically a melody in the amount of a piece of music (one tune) using the selected data sets of composition parameters in the storage subdivision 16B. The method of creating a melody, i.e. composing a piece of music may be the one as exemplified in the prior art description hereinbefore, or may be any other known method in the art. The music piece data representing the generated melody are written in the storage subdivision 16C of the RAM 16.

Next, a step 60 judges whether the length of time of the melody as generated at the step 58 is equal to the length of time as inputted (the length of time as represented by the data of the length of time in the storage subdivision 16A). If the judgment answer is affirmative (Y), it means that a melody of a desired length of time has been obtained, and the processing of composing music is brought to its end. If the judgment answer at the step 60 is negative (N), it means a melody having a desired length of time has not been obtained, and the processing moves to a step 62. The step 62 fine-adjusts the tempo of the music piece generated at the step 58 so that the length in time of the generated music piece be equal to the inputted length of time. Namely, the step 62 obtains a tempo value with which the length in time of the generated music piece becomes equal to the inputted length of time, and rewrite the tempo data in the storage subdivision 16A so as to represent the thus adjusted tempo value. In this case, the modification of the tempo value is by simply changing the inputted tempo value which is a temporary tempo value, and therefore the modification task is very easy. Actual examples of tempo modification will be described hereinafter. After the step 62 comes the end of the processing routine.

Next, two examples of composing a melody in the first embodiment will be described under the designation of the length of time for the melody. The first example is the one in which the following values are inputted at the step 50 for a music piece to be composed.

Length of time J=32 seconds

Tempo T=120 (quarter notes per minute)

Meter=4/4

The tempo T here means the number of quarter notes per minutes.

The length of time M of one measure in the case of 4/4 meter is obtained by the following formula:

$$M=60/T\times 4 \quad \text{(Eq. 1)},$$

in which M=60/120×4=2 seconds.

The number of measures necessary for the given length of time is obtained by the following formula:

$$N=J/M \quad \text{(Eq. 2)},$$

min which N=32/2=16 measures.

Based on the results of the above calculations, the step 54 search the data base for three data sets of defining characteristics of musical compositions (composition parameters) corresponding to the length of sixteen measures. Examples of the music structures defined by the three data sets of composition parameters are:

(1) A-A'-B-C; each sentence consists of four measures, (2) A-A'-B-A'; each sentence consists of four measures, (3) A-B; each sentence consists of eight measures, and these music structures are displayed on the screen of the display device 40. The alphabetic characters such as A, A', B and C are symbols representing the degrees of resemblance among the sentences, and a sequence of the symbols constitutes a sentence pattern.

As the user selects at the step 56 any desired music structure of the displayed (1)–(3), the data sets of defining characteristics of music compositions including the selected music structure are read out from the data base and loaded into the storage subdivision 16B. The step 58 then generates data of a melody based on the data sets of defining characteristics of music compositions in the storage subdivision 16B, and stores the generated data into the storage subdivision 16C.

The melody thus generated comprises sixteen measures, and the length of time J=32 seconds where the tempo T=120. The judgment at the step 60 results affirmative (Y) accordingly. So, there will take place no fine adjustment of the tempo at the step 62.

The second example is the one in which the following values are inputted at the step 50 for a music piece to be composed.

Length of time J=40 seconds

Tempo T=80 (quarter notes per minute)

Meter=4/4

The length of time M of one measure in the case of 4/4 meter is obtained by the above formula (Eq. 1), in which M=(60/80)×4=3 seconds.

The number of measures necessary for the given length of time is obtained by the above formula (Eq. 2), in which N=40/3=13.3 measures. When the obtained number N is a non-integer value such as 13.3, the step 54 conducts a data base search and a music structure display with respect to twelve or fourteen measures, which number is an integer near to "13.3".

For example, for the length of twelve measures, the display device 40 displays on its screen the following structure information:

(1) A-A'-B; each sentence consists of four measures, (2) A-A'-B'; each sentence consists of four measures, (3) A-B; each sentence consists of six measures.

And for the length of fourteen measures, the display device 40 displays on its screen the following structure information:

(1) A-B-A'; sentences are of six, six and two measures, (2) A-B-C'; sentences are of two, four and four measures, (3) A-B; sentences are of eight and six measures.

After this step, the process goes through the steps 56 and 58 as mentioned before about the first example.

In the second example of the first embodiment, however, the number of measures for a music piece (melody) to be composed is twelve or fourteen, wherein the case of twelve measures with the tempo T=80 requires the time length J=36, while the case of fourteen measures with the tempo T=80 requires the time length J=42, and either of these is not equal to the time length J=40 in the inputted composition conditions. The judgment result at the step 60 is negative (N) and the step 62 performs the processing of fine adjustment of the tempo. The tempo T is to be calculated with the following formula Eq. 3 derived from the above formulas Eqs. 1 and 2.

$$T=N/J\times 240 \qquad \text{(Eq. 3)}$$

Where the number of measures is twelve, the tempo T=12/40×240=72, and where the number of measures is fourteen, the tempo T=14/40×240=84. Accordingly, in the case of twelve measures, the tempo data in the storage subdivision 16A is rewritten to represent T=72, and in the case of fourteen measures, the tempo data in the storage subdivision 16A is rewritten to represent T=84.

Alternative to the illustrated performance of the step 60 in FIG. 3, the step 60 may be modified to judge whether the number of measures of the generated melody is equal to the number of measures N as calculated at the step 52.

According to the above described first embodiment; the length of time, the tempo and the meter for a music piece to be composed are designated at the step 52 as desired by the user; the necessary number of measures is obtained at the step 58 based on the designated length of time, tempo and meter; a music piece or melody is composed at the step 58 based on the composition parameter data sets (i.e. the data sets for defining characteristics of music compositions) corresponding to the obtained number of measures; and, if the time length of the composed music piece is not equal to the designated length of time, the tempo for the composed music piece is adjusted at the step 62 so that they become equal. Thus, a music piece or melody having a desired length of time can be correctly obtained. The generated melody data may then be supplied, under the control of the CPU 12, to the tone generator circuit 24 so that the user can hear the composed melody from the sound system 42.

Further, the data base is searched at the step 54 for plural data sets of composition parameters corresponding to the obtained number of measures and a plurality of music structures are displayed from the plural composition parameter data sets; an arbitrarily desired one is selected by the user at the step 56 from among the displayed plural music structures; and a music piece or melody is composed at the step 58 based on the composition parameter data sets having the selected music structure; and thus, the composed music piece will be the one which has not only a desired length of time, but also a desired music structure.

Figure 5:
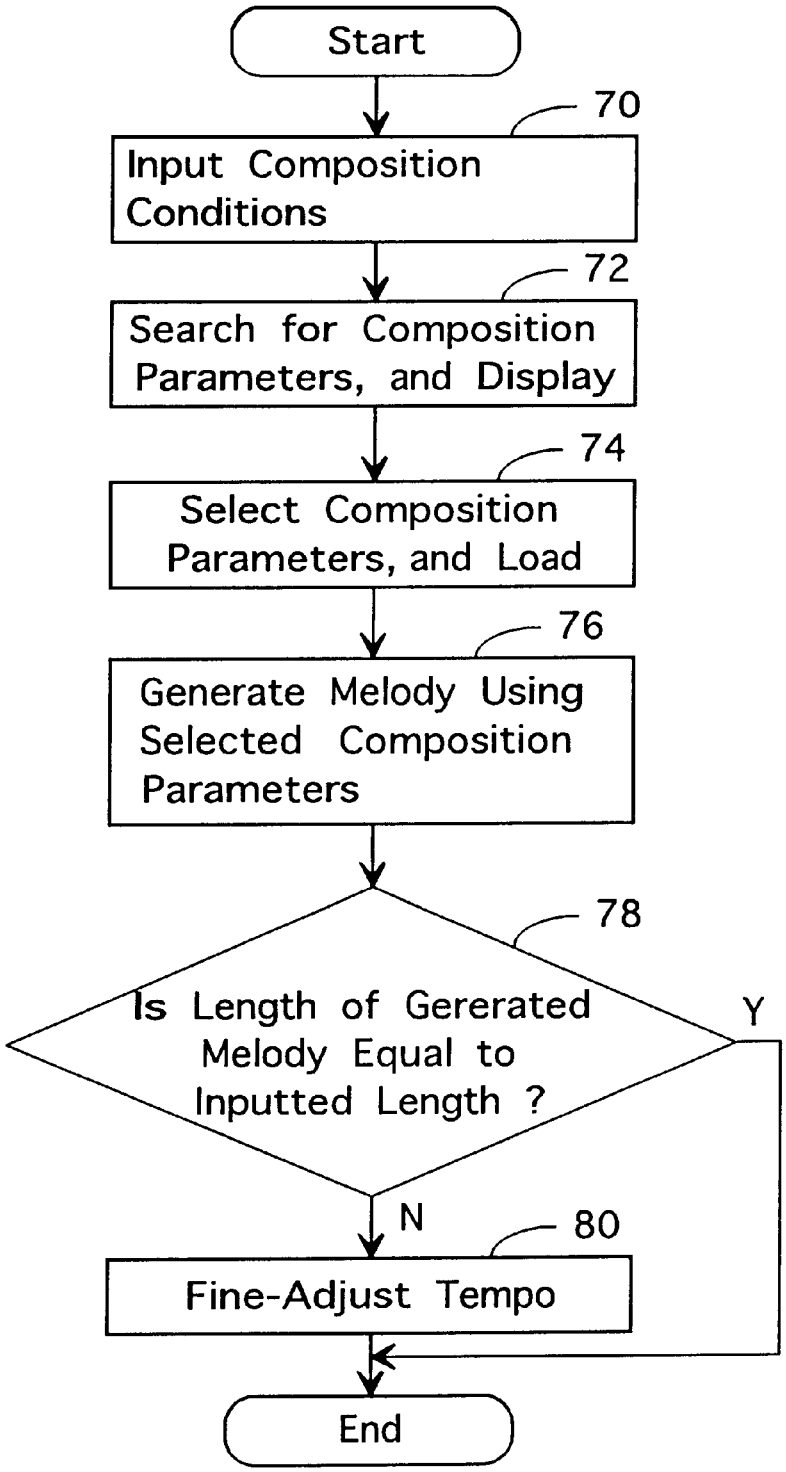
FIG. 5 is a flow chart showing the main routine of the processing for composing a music piece in a second embodiment of the present invention.

Next, described hereunder with reference to FIGS. 4 and 5 is a second embodiment of the present invention. In the second embodiment, a plurality of data sets of the composition parameters are provided (i.e. stored) for various lengths of time like 10 seconds, 20 seconds, 40 seconds and so forth, constituting a data base in the form of a list with respect to the tempo, the meter, the number of measures and the composition parameters. Namely, each set of composition parameters is attached with a tempo, a meter and a quantity of measures in contrast to those in the first embodiment. More specifically, FIG. 4 illustrates an example of how the data base is built, in which, for example, four sets of characteristic data for music composition are stored for the time length of 10 seconds, i.e. a set of composition parameters for "the tempo=96, the meter=4/4 and the number of measures=4"; for "the tempo=72, the meter=3/4 and the number of measures=4"; for "the tempo=192, the meter=4/4 and the number of measures=8"; and for "the tempo=144, the meter=3/4 and the number of measures=8". These four sets are different from each other in the combinations of the tempo, the meter and the number of measures, and the composition parameters (shown by phantom marks in FIG. 4) for each combination are different from each other combination. A music piece, if generated, using each set of composition parameters will be different from each other music piece in mood or atmosphere even for the same length of time such as 10 seconds. Similarly, a plurality of composition parameter data sets, each grouped with a tempo, a meter and the number of measures, are provided for each time length of 20 seconds, 40 seconds, . . . , 120 seconds.

FIG. 5 shows a music composing routine of the second embodiment. A step 70 is to input composition conditions for a music piece to be generated. The contents of the composition conditions and the manner of inputting the same are the same as at the step 50 in FIG. 3.

The step 72 searches the data base described hereinbefore for a plurality of data sets of composition parameters which meet the time length, the temporary tempo and the meter included in the inputted composition conditions, and displays the contents of the composition parameter data sets which best match the composition conditions on the panel of the display device 40, and in case there are plural candidates, the user is permitted to select any desired set of composition parameters from among the sets displayed on the panel by manipulating a switch or a mouse in the switch group 38. The length of time for the searched composition parameters are not necessarily be equal to the inputted length of time, but may be nearly equal thereto, and the composition parameters for such a nearly equal time length may be selected for the succeeding processing. For example, when the inputted length of time is 15 seconds, the display device 40 exhibits both the composition parameter sets for 10 seconds and those for 20 seconds for the user to select either of them. Further, the tempo and the meter may not necessarily be included in the composition conditions to be inputted, and the both or either of the two may be omitted. Still further, in this second embodiment, they may not be provided inherently as default values in the system. In case any of them are omitted, the search will be conducted for a plurality of composition parameter sets which meet the conditions other than the omitted one or ones, and the searched composition parameter sets will be displayed for the user's selection.

Next, a step 74 is to select any of the plurality of composition parameter data sets as displayed on the screen of the display device 40. Then, the step 74 reads out the selected composition parameter data sets from the above data base and loads (write) into the storage subdivision 16B of the RAM 16, before going forward to a step 76. The step 76 creates automatically a melody in the amount of a piece of music (one tune) using the selected data sets of composition parameters in the storage subdivision 16B. The music piece data representing the generated melody are written in the storage subdivision 16C of the RAM 16.

Next, a step 78 judges whether the length of time of the melody as generated at the step 76 is equal to the length of time as inputted. If the judgment answer is affirmative (Y), it means that a melody of a desired length of time has been obtained, and the processing of composing music is brought to its end. If the judgment answer at the step 78 is negative (N), it means a melody having a desired length of time has not been obtained, and the processing moves to a step 80. The step 80 fine-adjusts the tempo of the music piece generated at the step 76 (i.e. the tempo within the composition parameters) so that the length in time of the generated music piece be equal to the inputted length of time. After the step 80 comes the end of the processing routine. The generated melody data may then be supplied, under the control of the CPU 12, to the tone generator circuit 24 so that the user can hear the composed melody from the sound system 42.

While there is one set of composition parameter data stored in the storage device for a set of conditions of "the length of time, the tempo, the meter and the number of measures", for example, a condition set of "length of time= 10 seconds, the tempo=96, the meter=4/4 and the number of measures=4", there may be provided a plurality of sets of composition parameter data (for example, data sets for different sentence patterns) and the user may select a desired one from among them.

Although some specific examples of the present invention have been described above, this invention may not be limited to those examples described, but may be variously modified to perform the contemplated functions without departing from the spirit of the present invention. Examples of such a modification will be as follows.

(1) The adjustment of the tempo may not necessarily be limited to the uniform adjustment throughout the entire music piece from the beginning to the end, but may be such that some of the sentences or some of the measures in the music piece may be partially adjusted, or the tempo adjustment may be made by introducing a ritardando portion or an accelerando portion.

(2) The manner of displaying music structures may not necessarily be limited to displaying sentence patterns (in similarity symbols) and the number of measures for each sentence, but may be more specific to indicate like "an introduction section in four measures, a melody fraction of A in four measures, a melody fraction of B in two measures, a fill-in section in two measures and an ending section in four measures".

(3) The designation of the meter (or tempo) may be omitted from the composition conditions to be inputted. In such a situation, the number of measures may be obtained for each of several kinds of meters (or tempos), and composition parameter data sets corresponding to the obtained number of measures may be displayed for each meter (or tempo) to let the user select any desired composition parameter data set.

(4) In composing a music piece using the selected composition parameter data set, the composition parameter data set may be modified (repetition or omission of some section or sections) to meet the number of measures. Or, some processing may be incorporated for modifying the composed music data according to the music rules (grammar) after a music piece has been composed.

(5) The present invention is applicable not only to the generation of a melody tune, but also to the generation of a rhythm accompaniment piece or a bass accompaniment piece of music.

(6) The present invention may be practiced, not only in the form of an electronic musical instrument, but also in the form of a combination of a personal computer and application software. The application software may be stored in a storage medium such as a magnetic disk, a magneto-optical disk and a semiconductor memory to be supplied to the personal computer, or may be supplied to a personal computer from an external data base via a communication network.

(7) The present invention may be applicable not only to an electronic musical instrument, but also to the generation of music piece data sets for use in karaoke apparatus, etc.

(8) The present invention may be applicable not only to the electronic musical instrument of a keyboard type, but also to electronic musical instruments of other types such as a string instrument type, a wind instrument type and a percussion instrument type.

(9) The present invention is applicable, not only to an electronic musical instrument comprising therein a tone generator, an automatic performance device, etc., but also to an electronic musical instrument system as configured by combining a keyboard device, a tone generator device, an automatic music performing device, etc. with communication means such as MIDI and various other networks.

(10) The formats of the data for music performances of a melody, chords, etc. may not be limited to the "event+ relative time" style in which the time point of each event occurrence is expressed in relative times counted from each preceding event, but may also be the "event+absolute time" style in which the time points of the events are expressed in absolute times counted from the top of the music or each measure, or may be the "pitch (rest)+duration" style in which the music progression is expressed by note pitches, note durations, rests and rest durations, or may be the "event map" style in which memory addresses are previously assigned for all the time points in the musical progression and each event content is stored at the assigned address for that time point. Any other arbitrary style may also be employed.

(11) In generating (i.e. composing) music data in the amount of a plurality of channels (performance parts or instrument parts), the generated data for plural channels may be stored in an intermingled manner, but may be stored in a separate storage track for every channel.

(12) In storing the generated music piece data, the data may be stored at contiguous sites in the memory according to the lapse of time, or may be stored at skippingly scattered sites in the memory with an administration as contiguous data pieces of a designated sequence.

According to the present invention, as described hereinabove, a desired length of time is inputted for a music piece to be composed, and then the composition parameters for the tempo, the meter and the number of measures which satisfies the inputted length of time are selected by the user, and the apparatus automatically generates a music piece which meets the inputted composition conditions. More specifically, according to the first embodiment, a desired length of time is inputted for a music piece to be composed, and then the number of measures corresponding to a designated tempo and meter is obtained based on the inputted length of time, and automatic generation of a music composition is performed based on composition parameters which corresponds to the obtained number of measures. Thus, a music piece having a length in time which is equal to or approximately equal to the inputted length of time can be generated.

Further, as the present invention employs a structure of adjusting the tempo (which has been temporarily designated) so that the length in time of the composed music piece be made equal to the inputted length of time in case they should be unequal to each other, a composed music piece will surely have a length of time which is equal to the inputted length of time.

Still further, according to the present invention, a plurality of data sets of the composition parameters are searched for in the storage device in correspondence to the obtained number of measures, and a plurality of music structures included in the retrieved composition parameter data sets are displayed for user's selection, and therefore a music piece having a desired length of time and a desired music structure can be generated.

While several forms of the invention have been shown and described, other forms will be apparent to those skilled in the art without departing from the spirit of the invention. Therefore, it will be understood that the embodiments shown in the drawings and described above are merely for illustrative purposes, and are not intended to limit the scope of the invention, which is defined by the appended claims.

What is claimed is:

1. An automatic music composing apparatus comprising:

a storage device which stores a plurality of sets of composition parameter data for a plurality of numbers of measures, each set of composition parameter data defining characteristics of a music piece to be composed, and at least one set of composition parameter data being provided for each number of measures among said plurality of numbers of measures;

an input device for inputting a length of time for a music piece to be composed;

a tempo providing device which provides a tempo for a music piece to be composed;

a calculating device which calculates the number of measures for a music piece to be composed based on said inputted length of time and said tempo;

a read-out device which reads out from said storage device a set of composition parameter data which is for said calculated number of measures; and a music piece generating device which generates, based on said read out set of composition parameter data, a music piece having a length of time in said tempo and having characteristics as defined by said read out set of composition parameter data.

2. An apparatus according to claim 1, further comprising:

a detecting device which detects a disparity between said inputted length of time and the length of time of said generated music piece; and a tempo adjusting device which adjusts the tempo of said generated music piece so that said length of time of the generated music piece be substantially equal to said inputted length of time.

3. An apparatus according to claim 1, further comprising:

an input device for inputting a tempo for a music piece to be composed, said inputted tempo substituting for the tempo provided by said tempo providing device; and wherein said calculating device calculates the number of measures based on said inputted length of time and said inputted tempo.

4. An apparatus according to claim 1, further comprising:

an input device for inputting a meter for a music piece to be composed; and wherein said calculating device calculates the number of measures based on said inputted length of time, said provided tempo and said inputted meter.

5. An automatic music composing apparatus comprising:

a storage device which stores a plurality of sets of composition parameter data for a plurality of numbers of measures, each set of composition parameter data defining characteristics of a music piece to be composed, said characteristics including music structures, and at least one set of composition parameter data being provided for each number of measures among said plurality of numbers of measures;

an input device for inputting a length of time for a music piece to be composed;

a tempo providing device which provides a tempo for a music piece to be composed;

a calculating device which calculates the number of measures for a music piece to be composed based on said inputted length of time and said tempo;

a display device which displays a plurality of music structures defined by said plurality of sets of composition parameter data corresponding to said calculated number of measures;

a selecting device which selects a music structure from among said displayed plurality of music structures;

a read-out device which reads out from said storage device a set of composition parameter data including said selected music structure; and a music piece generating device which generates, based on said read out set of composition parameter data, a music piece having a length of time in said tempo and having characteristics as defined by said read out set of composition parameter data.

6. An apparatus according to claim 5, further comprising:

a detecting device which detects a disparity between said inputted length of time and the length of time of said generated music piece; and a tempo adjusting device which adjusts the tempo of said generated music piece so that said length of time of the generated music piece be substantially equal to said inputted length of time.

7. An apparatus according to claim 5, further comprising:

an input device for inputting a tempo for a music piece to be composed, said inputted tempo substituting for the tempo provided by said tempo providing device; and wherein said calculating device calculates the number of measures based on said inputted length of time and said inputted tempo.

8. An apparatus according to claim 5, further comprising:

an input device for inputting a meter for a music piece to be composed; and wherein said calculating device calculates the number of measures based on said inputted length of time, said provided tempo and said inputted meter.

9. An automatic music composing apparatus comprising:

a storage device which stores a plurality of sets of composition parameter data for a plurality of lengths of time, each set of composition parameter data defining characteristics of a music piece to be composed, and a plurality of sets of composition parameter data being provided for each length of time among said plurality of lengths of time;

an input device for inputting a length of time for a music piece to be composed;

a tempo providing device which provides a tempo for a music piece to be composed;

a read-out device which reads out from said storage device a set of composition parameter data which is for said inputted length of time; and a music piece generating device which generates, based on said read out set of composition parameter data, a music piece having a length of time in said tempo and having characteristics as defined by said read out set of composition parameter data.

10. An apparatus according to claim 9, further comprising:

a detecting device which detects a disparity between said inputted length of time and the length of time of said generated music piece; and a tempo adjusting device which adjusts the tempo of said generated music piece so that said length of time of the generated music piece be substantially equal to said inputted length of time.

11. A method for composing a music piece comprising the steps of:

storing in a storage device a plurality of sets of composition parameter data for a plurality of numbers of measures, each set of composition parameter data defining characteristics of a music piece to be composed, and at least one set of composition parameter data being provided for each number of measures among said plurality of numbers of measures;

inputting a length of time for a music piece to be composed;

providing a tempo for a music piece to be composed;

calculating the number of measures for a music piece to be composed based on said inputted length of time and said tempo;

reading out from said storage device a set of composition parameter data which is for said calculated number of measures; and generating, based on said read out set of composition parameter data, a music piece having a length of time in said tempo and having characteristics as defined by said read out set of composition parameter data.

12. A method according to claim 11, further comprising the steps of:

detecting a disparity between said inputted length of time and the length of time of said generated music piece; and adjusting the tempo of said generated music piece so that said length of time of the generated music piece be substantially equal to said inputted length of time.

13. A method according to claim 11, further comprising the step of:

inputting a tempo for a music piece to be composed, said inputted tempo substituting for the tempo provided by said tempo providing step; and wherein said calculating step calculates the number of measures based on said inputted length of time and said inputted tempo.

14. A method according to claim 11, further comprising the step of:

inputting a meter for a music piece to be composed; and wherein said calculating step calculates the number of measures based on said inputted length of time, said provided tempo and said inputted meter.

15. A method for composing a music piece comprising the steps of:

storing a plurality of sets of composition parameter data for a plurality of numbers of measures, each set of composition parameter data defining characteristics of a music piece to be composed, said characteristics including music structures, and at least one set of composition parameter data being provided for each number of measures among said plurality of numbers of measures;

inputting a length of time for a music piece to be composed;

providing a tempo for a music piece to be composed;

calculating the number of measures for a music piece to be composed based on said inputted length of time and said tempo;

displaying a plurality of music structures defined by said plurality of sets of composition parameter data corresponding to said calculated number of measures;

selecting a music structure from among said displayed plurality of music structures;

reading out from said storage device a set of composition parameter data including said selected music structure; and generating, based on said read out set of composition parameter data, a music piece having a length of time in said tempo and having characteristics as defined by said read out set of composition parameter data.

16. A method according to claim 15, further comprising the steps of:

detecting a disparity between said inputted length of time and the length of time of said generated music piece; and adjusting the tempo of said generated music piece so that said length of time of the generated music piece be substantially equal to said inputted length of time.

17. A method according to claim 15, further comprising the step of:

inputting a tempo for a music piece to be composed, said inputted tempo substituting for the tempo provided by said tempo providing step; and wherein said calculating step calculates the number of measures based on said inputted length of time and said inputted tempo.

18. A method according to claim 15, further comprising the step of:

inputting a meter for a music piece to be composed; and wherein said calculating step calculates the number of measures based on said inputted length of time, said provided tempo and said inputted meter.

19. A method for composing a music piece comprising the steps of:

storing a plurality of sets of composition parameter data for a plurality of lengths of time, each set of composition parameter data defining characteristics of a music piece to be composed, and a plurality of sets of composition parameter data being provided for each length of time among said plurality of lengths of time;

inputting a length of time for a music piece to be composed;

providing a tempo for a music piece to be composed;

reading out from said storage device a set of composition parameter data which is for said inputted length of time; and generating, based on said read out set of composition parameter data, a music piece having a length of time in said tempo and having characteristics as defined by said read out set of composition parameter data.

20. A method according to claim 19, further comprising the steps of:

detecting a disparity between said inputted length of time and the length of time of said generated music piece; and adjusting the tempo of said generated music piece so that said length of time of the generated music piece be substantially equal to said inputted length of time.

21. A machine readable medium for use in an apparatus for composing a music piece, said apparatus being of a data processing type comprising a computer and a storage device, said medium containing program instructions executable by said computer for executing:

a process of storing in said storage device a plurality of sets of composition parameter data for a plurality of numbers of measures, each set of composition parameter data defining characteristics of a music piece to be composed, and at least one set of composition parameter data being provided for each number of measures among said plurality of numbers of measures;

a process of inputting a length of time for a music piece to be composed;

a process of providing a tempo for a music piece to be composed;

a process of calculating the number of measures for a music piece to be composed based on said inputted length of time and said tempo;

a process of reading out from said storage device a set of composition parameter data which is for said calculated number of measures; and a process of generating, based on said read out set of composition parameter data, a music piece having a length of time in said tempo and having characteristics as defined by said read out set of composition parameter data.

22. A machine readable medium according to claim 21, further containing program instructions for executing:

a process of detecting a disparity between said inputted length of time and the length of time of said generated music piece; and a process of adjusting the tempo of said generated music piece so that said length of time of the generated music piece be substantially equal to said inputted length of time.

23. A machine readable medium according to claim 21, further containing program instructions for executing:

a process of inputting a tempo for a music piece to be composed, said inputted tempo substituting for the tempo provided by said tempo providing process; and wherein said calculating process is to calculate the number of measures based on said inputted length of time and said inputted tempo.

24. A machine readable medium according to claim 21, further containing program instructions for executing:

a process of inputting a meter for a music piece to be composed; and wherein said calculating process is to calculate the number of measures based on said inputted length of time, said provided tempo and said inputted meter.

25. A machine readable medium for use in an apparatus for practicing a musical instrument, said apparatus being of a data processing type comprising a computer, a display device and a storage device, said medium containing program instructions executable by said computer for executing:

a process of storing a plurality of sets of composition parameter data for a plurality of numbers of measures, each set of composition parameter data defining characteristics of a music piece to be composed, said characteristics including music structures, and at least one set of composition parameter data being provided for each number of measures among said plurality of numbers of measures;

a process of inputting a length of time for a music piece to be composed;

a process of providing a tempo for a music piece to be composed;

a process of calculating the number of measures for a music piece to be composed based on said inputted length of time and said tempo;

a process of displaying on said display device a plurality of music structures defined by said plurality of sets of composition parameter data corresponding to said calculated number of measures;

a process of selecting a music structure from among said displayed plurality of music structures;

a process of reading out from said storage device a set of composition parameter data including said selected music structure; and a process of generating, based on said read out set of composition parameter data, a music piece having a length of time in said tempo and having characteristics as defined by said read out set of composition parameter data.

26. A machine readable medium according to claim 25, further containing program instructions for executing:

a process of detecting a disparity between said inputted length of time and the length of time of said generated music piece; and a process of adjusting the tempo of said generated music piece so that said length of time of the generated music piece be substantially equal to said inputted length of time.

27. A machine readable medium according to claim 25, further containing program instructions for executing:

a process of inputting a tempo for a music piece to be composed, said inputted tempo substituting for the tempo provided by said tempo providing process; and wherein said calculating process is to calculate the number of measures based on said inputted length of time and said inputted tempo.

28. A machine readable medium according to claim 25, further containing program instructions for executing:

a process of inputting a meter for a music piece to be composed; and wherein said calculating process is to calculate the number of measures based on said inputted length of time, said provided tempo and said inputted meter.

29. A machine readable medium for use in an apparatus for practicing a musical instrument, said apparatus being of a data processing type comprising a computer and a storage device, said medium containing program instructions executable by said computer for executing:

a process of storing a plurality of sets of composition parameter data for a plurality of lengths of time, each set of composition parameter data defining characteristics of a music piece to be composed, and a plurality of sets of composition parameter data being provided for each length of time among said plurality of lengths of time;

a process of inputting a length of time for a music piece to be composed;

a process of providing a tempo for a music piece to be composed;

a process of reading out from said storage device a set of composition parameter data which is for said inputted length of time; and a process of generating, based on said read out set of composition parameter data, a music piece having a length of time in said tempo and having characteristics as defined by said read out set of composition parameter data.

30. A machine readable medium according to claim 29, further containing program instructions for executing:

a process of detecting a disparity between said inputted length of time and the length of time of said generated music piece; and a process of adjusting the tempo of said generated music piece so that said length of time of the generated music piece be substantially equal to said inputted length of time.

31. An automatic music composing apparatus comprising:

means for storing a plurality of sets of composition parameter data for a plurality of numbers of measures, each set of composition parameter data defining characteristics of a music piece to be composed, and at least one set of composition parameter data being provided for each number of measures among said plurality of numbers of measures;

means for inputting a length of time for a music piece to be composed;

means for providing a tempo for a music piece to be composed;

means for calculating the number of measures for a music piece to be composed based on said inputted length of time and said tempo;

means for reading out from said storage device a set of composition parameter data which is for said calculated number of measures; and means for generating, based on said read out set of composition parameter data, a music piece having a length of time in said tempo and having characteristics as defined by said read out set of composition parameter data.

32. An automatic music composing apparatus comprising:

means for storing a plurality of sets of composition parameter data for a plurality of numbers of measures, each set of composition parameter data defining characteristics of a music piece to be composed, said characteristics including music structures, and at least one set of composition parameter data being provided for each number of measures among said plurality of numbers of measures;

means for inputting a length of time for a music piece to be composed;

means for providing a tempo for a music piece to be composed;

means for calculating the number of measures for a music piece to be composed based on said inputted length of time and said tempo;

means for displaying a plurality of music structures defined by said plurality of sets of composition parameter data corresponding to said calculated number of measures;

means for selecting a music structure from among said displayed plurality of music structures;

means for reading out from said storage device a set of composition parameter data including said selected music structure; and means for generating, based on said read out set of composition parameter data, a music piece having a length of time in said tempo and having characteristics as defined by said read out set of composition parameter data.

* * * * *